United States Patent [19]

Johnson et al.

[11] 4,288,312

[45] Sep. 8, 1981

[54] CATHODE AND EDGE STICK ASSEMBLY

[75] Inventors: Ralph E. Johnson; Reno P. Biscaro, both of Trail, Canada

[73] Assignee: Cominco Ltd., Vancouver, Canada

[21] Appl. No.: 99,030

[22] Filed: Nov. 30, 1979

[30] Foreign Application Priority Data

Aug. 13, 1979 [CA] Canada ..... 333639

[51] Int. Cl.[3] ..... C25C 7/02; C25D 17/10

[52] U.S. Cl. ..... 204/281; 204/286; 204/288; 204/297 R

[58] Field of Search ..... 204/281, 286–288, 204/297 R, 297 W

[56] References Cited

U.S. PATENT DOCUMENTS 3,298,945 1/1967 Weis et al. ..... 204/242
3,414,502 12/1968 Porrata et al. ..... 204/281
4,186,074 1/1980 Perry ..... 204/286

FOREIGN PATENT DOCUMENTS 584058 1/1978 U.S.S.R. ..... 204/288

*Primary Examiner*—F. Edmundson
*Attorney, Agent, or Firm*—Wenderoth, Lind & Ponack

[57] ABSTRACT

A cathode assembly for the electrodeposition of metals comprising in combination at least one edge stick engaging at least one edge of a cathode, wherein the cathode has at least one upstanding projection on each of its surfaces proximate said edge, the projections each having an upstanding face which is both substantially parallel to the proximate cathode edge and facing away therefrom, and wherein the non-conductive plastic edge stick is of channel-like form, the inner trough faces of the channel being adapted to engage securely with the projections proximate the cathode edge, thereby to retain the edge stick thereupon. This assemblage has the advantages of simplicity of construction and assembly, while also avoiding any weakening of the cathode edge.

14 Claims, 8 Drawing Figures

CATHODE AND EDGE STICK ASSEMBLY

BACKGROUND OF THE INVENTION (a) Field of the Invention

This invention relates to an improved cathode assembly for the electrodeposition of metals, comprising a cathode having attached thereto a pair of non-conductive edge sticks. More particularly this invention relates to an improved cathode to which edge sticks may be more easily and permanently attached.

(b) Description of the Prior Art

In electrolytic metal refining and electrowinning processes it has long been realised that in order to be able to recover the deposited metal from the cathode "starter sheet" that often is used, it is necessary to protect the edges of the cathode. By this means, bridging of the deposited metal between the two faces of the cathode is prevented. Originally, wooden sticks were used, which had a groove adapted to fit tightly to the edge of the cathode. These wooden sticks suffer from many disadvantages, most of which arise as a consequence of the poor resistance of the wood to the generally very acid conditions obtaining in the electrolysis cells. Many attempts have been made to provide an edge stick which is both effective, and comparatively cheap, and at the same time both robust and capable of secure attachment to the cathode sheet. These two last desiderata have lately assumed more importance, since the use of cathode-stripping machinery has been introduced.

Most of the proposals made involve removal of material from the edge regions of the cathode in some way to provide a means of attachment for the edge strip. Thus in U.S. Pat. No. 684,291 (issued Oct. 8, 1901 to W. A. McCoy) is described a cathode with a grooved edge, the groove shape being unspecified, or with a perforated edge, to which asphalt is applied. In U.S. Pat. No. 1,470,883 (issued Oct. 16, 1923 to C. H. Schuh) is described a cathode having a rabbeted edge, which edge is perforated; a channel-like edge stick is used which is held on by rivets through the perforations. An improvement of this technique is described in U.S. Pat. No. 1,857,903 (issued May 10, 1932 to A. G. Wensley) wherein what may be described as rubber rivets are used. All of these proposals involve shaping the edge of the cathode before use.

Edge-shaping of the cathode can be an expensive procedure: various proposals have been made to avoid this and attach the edgestick by other means. In U.S. Pat. No. 1,994,144 (issued Mar. 12, 1935 to A. B. Merrill) a vulcanization procedure is proposed. Others have proposed to use adhesives. In U.S. Pat. No. 3,798,151 (issued Mar. 19, 1974 to A. Takamura et al) is proposed a wedge system, wherein a wedge is inserted into the outer face of the edge stick to cause it to bind more tightly onto the edge of an undeformed cathode. In U.S. Pat. No. 2,343,161 a related technique is proposed, involving a metallic channel-like stiffener inside a rubber channel edge stick. A further variant is described in U.S. Pat. No. 3,830,710 (issued Aug. 20, 1974 to J. S. Narozanski et al) wherein the edge of the cathode is notched at its upper and lower ends to retain an edge strip which is stretched to engage the cathode resiliently.

A very simple system involving split plastic tubing and a grooved cathode edge is described in U.S. Pat. No. 2,536,877 (issued Jan. 2, 1951 to W. A. Emmanuel et al) wherein the slit tubing is opened and the edge of the cathode inserted into the slit: in attempting to return to its circular configuration, the tubing engages into the grooves.

All of these systems suffer from either, or both, of two disadvantages: complexity and potential weakening of the cathode edges. And with complexity inevitably arises cost problems. Any edge weakening, as is caused, for example, by a continuous edge groove, is not desirable as this makes the assembly of cathode and edge sticks less robust, and thus less able to sustain the rigours of modern mechanical handling equipment, especially automated cathode stripping equipment.

SUMMARY OF THE INVENTION

This invention seeks to provide a comparatively simple, cheap, and yet robust cathode assembly utilizing an edge stick. Edge stick retention means is provided without weakening the cathode edge by removal of metal.

Thus in a first embodiment this invention provides a cathode assembly for the electrodeposition of metals comprising in combination at least one edge stick engaging at least one edge of a cathode, wherein the cathode has at least one upstanding projection on each of its surfaces proximate said edge, the projections each having an upstanding face which is both substantially parallel to the proximate cathode edge and facing away therefrom, the faces preferably also being of substantially the same upstanding height and at substantially the same distance from the proximate cathode edge, and the edge stick is non-conductive plastic material of channel-like form, the inner trough faces of the channel being adapted to engage securely with the projections proximate the cathode edge, thereby to retain the edge stick thereon.

In a second embodiment this invention provides a method of making a cathode assembly comprising in combination at least one nonconductive plastic edge stick engaging at least one edge of a cathode, which method comprises forming, proximate said edge of the cathode, at least one upstanding projection on each face of the cathode, the projections each having an upstanding face which is both substantially parallel to the proximate cathode edge and facing away therefrom, the faces also preferably being of substantially the same upstanding height and at substantially the same distance from the proximate cathode edge, by deforming the metal of the cathode in the region proximate said edge; forming a non-conductive plastic edge stick of channel-like form having inner trough faces adapted to engage with the projections formed proximate the cathode edge; and applying the edge stick to the cathode edge securely engaging the edge stick with the projections formed proximate the cathode edge.

In a preferred aspect of the invention, the edge stick comprises a longitudinally extending channel member wherein the channel trough faces are mutually inclined toward each other and are provided, at their outer edges, with a projecting lip adapted to engage over the projections on the cathode. Conveniently, the cathode edge stick is formed by extruding a suitable non-conductive plastics material through a suitable die.

In another preferred aspect of the invention, the cathode is provided with a plurality of relatively short projections proximate at least one edge thereof, each projection having the required upstanding face, the summed length of the upstanding faces being in total substantially less than the total length of the proximate cathode edge, e.g. approximately one quarter.

BRIEF DESCRIPTION OF THE DRAWINGS

The invention will now be described in detail, by way of reference to the attached figures, in which.

DESCRIPTION OF THE PREFERRED EMBODIMENTS

Figure 1:
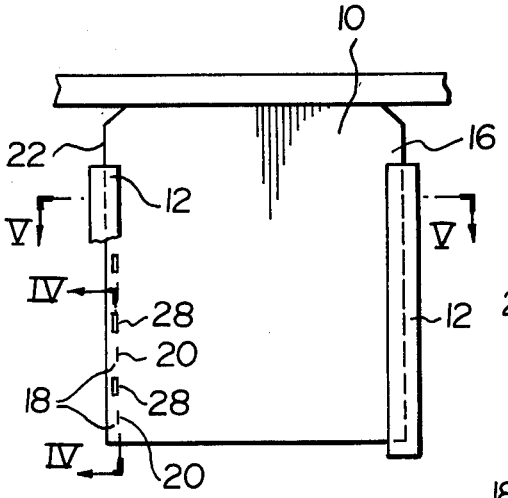
FIG. 1 shows a cathode assembly wherein part of one edge stick is removed.

As shown in FIG. 1, the cathode comprises a metallic sheet, 10, attached to a header bar (to which, in turn, suitable electrical contact is made; this detail is omitted from the figure and is conventional) as its support. To each vertical edge 16 of the cathode are applied edge sticks, 12. The edge stick 12 covers at least that portion of the edge 16 of the cathode 10 which will be in or near the electrolyte when the cathode is placed in an electrolysis cell. It usually projects slightly beyond the bottom edge of the cathode to prevent undesirable bridging of deposited metal. To ensure continued projection of the edge stick beyond the bottom of the cathode, cathode edge 16 may be deformed near its upper end to prevent longitudinal movement of the edge stick caused by impact on the bottom end. One edge stick 12 is shown partly cut away, to reveal the projections formed in the edge region 16 of the cathode. These are more clearly shown in FIGS. 2 and 5 to comprise an upstanding, relatively short, projection 18, having an upstanding face 20 which is substantially parallel to the proximate cathode edge face 22. As indicated in FIGS. 1 and 2 there is a plurality of projections 18, and they are arranged both substantially in line and the same distance from the proximate edge face 22.

Figure 2:
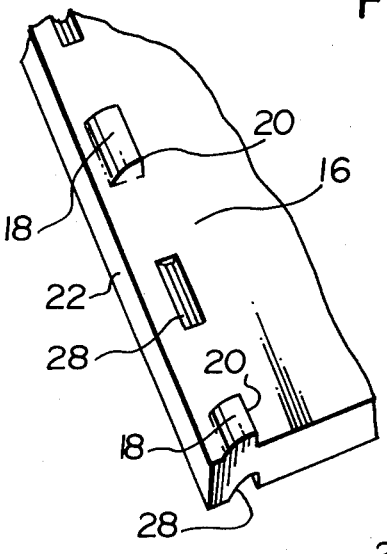
FIG. 2 shows a perspective view of an edge portion of the cathode of FIG. 1.

FIG. 2 also shows that a line of projections 18 is formed on both faces of the cathode sheet 10. As can be seen from FIG. 5, the two lines of projections are preferably placed with their faces 20 aligned at the same distance from the proximate cathode edge face 22.

Figure 4:
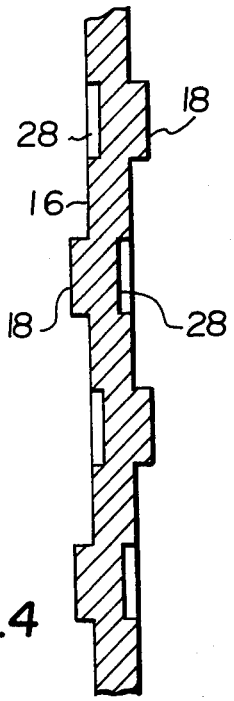
FIG. 4 shows a sectional view on the line IV—IV of FIG. 1.
Figure 5:
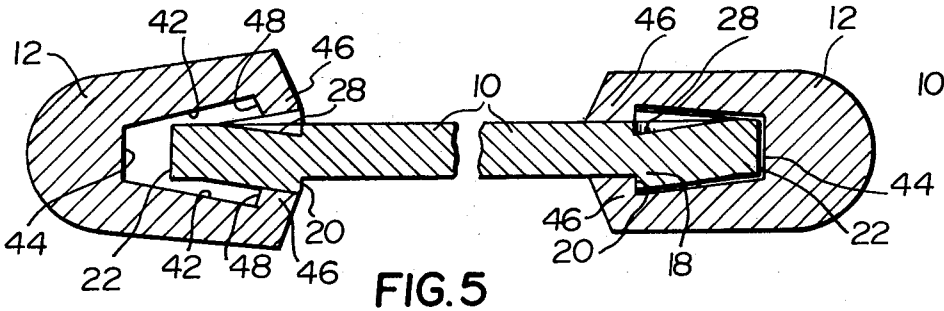
FIG. 5 shows a sectional view on the line V—V of FIG. 1 adapted to show placement of one edge stick on the cathode.
Figure 6:
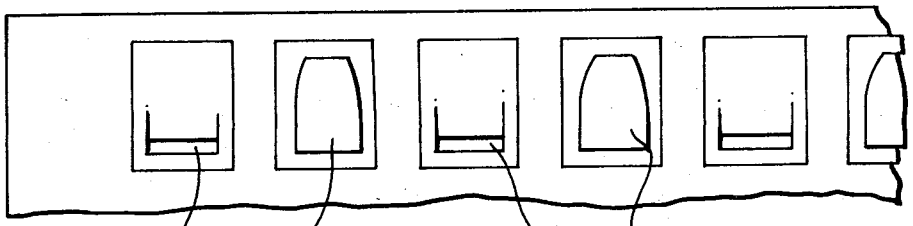
FIG. 6 shows a die suitable for making the cathode of FIG. 1.

The projections 18 are conveniently obtained by pressing the edge portion 16 of the cathode sheet 10 between a pair of dies, of the type shown schematically in plan in FIG. 6. These dies utilise alternate cavities 24 and punches 26. When pressed in a cooperating pair onto the edge portion 16 to the cathode, the punches 24 deform the cathode metal into cooperating cavities 26, thus leaving depressions 28 as they form projections 18 on the other side (FIG. 2). Suitable shaping of the die cavity 24 ensures that the projection 18 is formed with the required upstanding face 20. The relationship between the resulting depressions and projections can be clearly seen in FIGS. 4 and 5.

Figure 3:
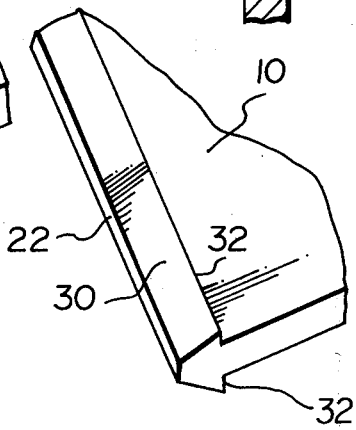
FIG. 3 shows a perspective view of an alternate form of projection.
Figure 7:
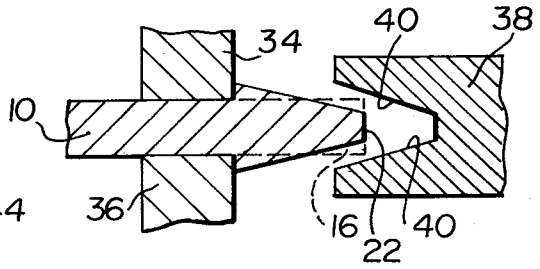
FIG. 7 shows diagrammatically a means for making the cathode of FIG. 3.

An alternative form of projection is shown in FIG. 3, wherein a continuous single projection 30 is provided on each face of the cathode sheet 10 having a continuous upstanding face 32. A similar projection 30 is provided on the other side of the sheet, which also has an upstanding face 32. This form of projection can be made by the method shown schematically in FIG. 7. The cathode sheet 10 is clamped between die plates 34, 36 to leave protruding (shown dotted) edge portion 16. A roller, 38, having tapered faces 40 is then pressed against proximate cathode edge 22, deforming the metal to provide the required shape.

Figure 8:
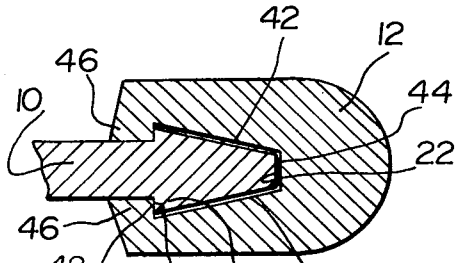
FIG. 8 shows in section a cathode of FIG. 3 with an attached edge strip.

Turning now to FIGS. 5 and 8, it can be seen that the same form of edge stick is used for both preferred types of projections. The body, 12, of the edge stick is formed with a channel having inner faces 42, and a base or center face 44. The outer edges of these channel faces are provided with inwardly projecting lips 46, each of which has an inner face 48. The external shape of the edge stick is not important: the rounded contour shown in the figures has been found to be suitable. The major requirement is that the stick shall be flexible enough to be spread open as lips 46 move over projections 20—as shown in the left side of FIG. 5—during its application to the edge of the cathode. Further, it is advantageous that the gap between the lips 46, before the stick is applied, is somewhat less than the thickness of the cathode metal plate 10 to provide resilient engagement with opposite cathode faces.

The configuration adopted by the edge stick when applied to the edge of the cathode is clearly shown in FIGS. 5 and 8. The proximate cathode edge face 22 approaches abutment against the face 44 at the base of the channel in the edge stick as the inward lips 46 of the edge stick engage closely the projections 18 (FIG. 5) and 30 (FIG. 8), the faces 48 and 20 (FIG. 5) or 48 and 32 (FIG. 8) being in substantial contact. Thus the edge strip is engaged by a "snap-on" engagement to provide a permanent assembly.

If desired, an electrolyte-resistant adhesive or filler may also be used to fill any gaps remaining between the edge stick and the cathode. This can be applied either to the cathode, or to the face 44 of the edge stick before assembly. Assembling the edge stick onto the cathode edge will then also serve to spread out the adhesive to fill any remaining cavities.

It is apparent from the preceding detailed description that many features of this invention are open to modification. The most obvious variant is the distance between the face of the projection, and the edge of the cathode. This is clearly a matter of choice; applicants have found that for a cathode of about 5 mm thickness, it is convenient to have the projection faces about 7 to 10 mm from the edge. Similarly an upstanding height for the projections of about 1 mm has been found suitable. Where the multiple projections concept (of FIG. 2) is used, then several variables arise. It is easiest to have the projections formed by means of cooperating dies, and thus they cannot be directly opposite each other. However, a modification of the roller technique used for the continuous projection would do this. It is preferred to alternate the projections on either side of the cathode, but this is far from the only possible arrangement. The determining factor is the requirement to ensure that there are enough projections to retain the edge strip properly. As an alternative to paired dies, a pair of contoured rollers could also be used.

There is also considerable choice for the plastic material for the edge-stick, many suitable ones being discussed in the literature. The relevant criteria are that it be non-conducting, non-fragile, and have sufficient elasticity and rigidity to grip the edge of the cathode. It must also withstand the somewhat rigorous conditions pertaining in the bath. A preferred material is an acrylonitrile-butadiene-styrene copolymer.

What is claimed is:

1. A cathode assembly for the electrodeposition of metals comprising in combination at least one edge stick engaging at least one edge of a cathode, wherein the cathode has at least one upstanding projection on each of its surfaces proximate said edge, the projections each having an upstanding face which is both substantially parallel to the proximate cathode edge and facing away therefrom, and wherein the non-conductive plastic edge is of channel-like form, the inner trough faces of the channel being provided with projecting lips at their outer edges adapted to move over the projections on each surface of the cathode proximate the cathode edge and to engage opposite cathode faces resiliently and securely, thereby to retain the edge stick thereon.

2. An assembly as claimed in claim 1 wherein the faces of the projections are of substantially the same upstanding height and are at substantially the same distance from the proximate cathode edge.

3. An assembly as claimed in claim 1 wherein the cathode is provided with edge sticks over at least that portion of its side edges which will be either in or close to the cell electrolyte.

4. An assembly as claimed in claim 1 or 2 wherein the upstanding projections are each continuous and of substantially the same length as the cathode edge.

5. An assembly as claimed in claim 1 or 2 wherein the cathode has a plurality of upstanding projections on each surface, the upstanding faces thereof on each surface of the cathode being substantially in a line parallel to the proximate cathode edge.

6. An assembly as claimed in claim 1 or 6 wherein the edge stick is fabricated from an acrylonitrile-butadiene-styrene copolymer.

7. An assembly as claimed in claim 1 further incorporating an adhesive or sealant interposed between the edge stick and the cathode.

8. A method of making a cathode assembly comprising in combination at least one non-conductive plastic edge stick engaging at least one edge of a cathode, which method comprises forming, proximate said edge of the cathode by deforming the metal of the cathode in a region proximate said edge, at least one upstanding projection on each face of the cathode, the projections each having a face which is substantially parallel to the proximate cathode edge and facing away therefrom; forming a non-conductive plastic edge stick of channel-like form having inner trough faces with lips at the outer edge of the channel trough faces projecting inwardly and adapted to move over the projections formed proximate the edge of the cathode and to engage opposite cathode faces both resiliently and securely; and applying the edge stick to the cathode edge securely and resiliently engaging the edge stick with the projections formed proximate the cathode edge.

9. A method according to claim 8 wherein the upstanding projections on each face of the cathode are formed at substantially the same distance from the proximate cathode edge, and are each formed substantially the same upstanding height.

10. A method according to claim 8 wherein a single upstanding projection is formed on each face of the cathode proximate its edge, and extending substantially the full length of that edge.

11. A method according to claim 8 wherein a plurality of projections are formed on each face of the cathode, the upstanding faces of which are each substantially parallel to the proximate cathode edge and are each substantially the same distance from the proximate cathode edge.

12. A method according to claim 8 wherein the edge stick is formed by extruding a non-conducting plastic material.

13. A method according to claim 8 including the further step of applying an adhesive or sealer composition to the edge of the cathode before the edge stick is applied thereto.

14. A method according to claim 8 including the additional step of applying an adhesive or sealer composition to at least one face of the trough in the edge stick before the edge stick is applied to the cathode.

* * * * *